US008025387B2

(12) United States Patent
Ozawa

(10) Patent No.: US 8,025,387 B2
(45) Date of Patent: Sep. 27, 2011

(54) INKJET PRINTER

(75) Inventor: Chizuo Ozawa, Nagano (JP)

(73) Assignee: Mastermind Co., Ltd., Shiojiri-shi (JP)

( * ) Notice: Subject to any disclaimer, the term of this patent is extended or adjusted under 35 U.S.C. 154(b) by 498 days.

(21) Appl. No.: 12/224,117

(22) PCT Filed: Feb. 27, 2007

(86) PCT No.: PCT/JP2007/000131

§ 371 (c)(1),
(2), (4) Date: Aug. 15, 2008

(87) PCT Pub. No.: WO2007/099704

PCT Pub. Date: Sep. 7, 2007

(65) Prior Publication Data

US 2009/0219327 A1 Sep. 3, 2009

(30) Foreign Application Priority Data

Feb. 28, 2006 (JP) ..... 2006-052142
Jun. 12, 2006 (JP) ..... 2006-162377

(51) Int. Cl.
*B41J 2/01* (2006.01)
*H05B 11/00* (2006.01)

(52) U.S. Cl. ..... 347/102; 219/216

(58) Field of Classification Search ..... 347/102; 219/216

See application file for complete search history.

(56) References Cited

U.S. PATENT DOCUMENTS 4,411,516 A * 10/1983 Adachi et al. ..... 362/294
5,231,423 A 7/1993 Wataya et al.
6,911,108 B2 * 6/2005 Sarmiento ..... 219/243
7,137,694 B2 * 11/2006 Ferran et al. ..... 347/102
7,407,253 B2 * 8/2008 Yokoyama et al. ..... 347/102

(Continued)

FOREIGN PATENT DOCUMENTS

EP 1 293 846 A2 3/2003

(Continued)

OTHER PUBLICATIONS

Search Report for European Patent Office dated Mar. 3, 2010 (6 pages).

(Continued)

*Primary Examiner* — Shelby Fidler
(74) *Attorney, Agent, or Firm* — Flynn, Thiel, Boutell & Tanis, P.C.

(57) ABSTRACT

A heating lamp unit (40) is mounted on a head carriage (10) of an inkjet printer (1). Since the heating lamp unit (40) is positioned very close to an ink drop, which is discharged from the inkjet head (11) and dropped on a recording medium (30), and that the heating lamp unit can directly harden the ink drop with heat, the ink drop can be efficiently fixed. When the heating lamp unit (40) is arranged very close to the inkjet head (11), there are possibilities of generating clogging of the nozzle of the inkjet head (11) and thermal failure of the inkjet head itself due to heat released from the heating lamp (40). Since the heating lamp unit (40) can be efficiently cooled by a cooling mechanism (50) using heat pipes (51, 52), the inkjet head can be prevented from being heated.

6 Claims, 8 Drawing Sheets

U.S. PATENT DOCUMENTS

| | | | | |
|---|---|---|---|---|
| 2003/0043246 | A1* | 3/2003 | Codos | 347/102 |
| 2003/0151656 | A1 | 8/2003 | Kokubo et al. | |
| 2004/0264197 | A1* | 12/2004 | Bewig et al. | 362/294 |
| 2005/0158687 | A1 | 7/2005 | Dahm | |
| 2006/0152541 | A1* | 7/2006 | Isozaki et al. | 347/17 |
| 2010/0220141 | A1* | 9/2010 | Ozawa | 347/18 |

FOREIGN PATENT DOCUMENTS

| | | | | |
|---|---|---|---|---|
| JP | 54107735 | A | * | 8/1979 |
| JP | 55-095937 | A | | 7/1980 |
| JP | 63-109083 | A | | 5/1988 |
| JP | 01007945 | A | * | 1/1989 |
| JP | 02-258346 | A | | 10/1990 |
| JP | 3-133654 | A | | 6/1991 |
| JP | 05-038815 | A | | 2/1993 |
| JP | 10-223549 | A | | 8/1998 |
| JP | 2000-190467 | A | | 11/2000 |
| JP | 2001-006431 | A | | 1/2001 |
| JP | 2005-262518 | A | | 9/2005 |

OTHER PUBLICATIONS

International Search Report dated Apr. 10, 2007 (2 pages).

* cited by examiner

INKJET PRINTER

TECHNICAL FIELD

The present invention relates to an inkjet printer suitable for printing on the surfaces of recording media of various materials, such as paper, cloth, films, glass plates, metal plates, resin plates, and wooden plates.

BACKGROUND ART

Inkjet printers have been proposed wherein an inkjet printer can be used to print on various recording media differing in thickness and size. In Patent Document 1, the present applicants have proposed a large-sized inkjet printer suitable for printing on the surfaces of wooden plates, round wooden objects, and other such thick recording media. This large-sized printer is configured so that printing is performed by conveying a medium-conveying tray carrying a recording medium through the printing position of the print head. The printer is also configured so that the gap between the print head and the recording medium is adjusted by raising and lowering the conveying mechanism of the medium-conveying tray. [Patent Document 1] JP-A 2000-190467

In the inkjet printer, ink droplets discharged from the inkjet head are deposited on the surface of the recording medium. The droplets harden as they are absorbed, and the droplets become fixed on the surface. The recording medium surface can be heated in order to efficiently fix the deposited ink droplets. Heating is particularly effective in cases in which printing is performed on a recording medium composed of a material on which aqueous ink, solvent ink, or the like does not readily fix. In cases in which printing is performed using a thermosetting ink such as resin ink or the like, heating is essential because the ink droplets deposited on the recording medium must be heated and hardened.

In a common heating method, a platen regulating the printing position of the inkjet head is heated, and the portion of the recording medium where the ink droplets are deposited is also heated. However, although this heating method is effective with a thin recording medium such as paper, this method is not effective in the case of a thick recording medium because a long time is required in order to heat the recording medium to a temperature suitable for hardening the ink.

The inkjet head is disposed facing the platen across a small gap, and printing is performed while the inkjet head moves along the platen. Accordingly, with a method for heating the platen, the inkjet head facing the platen is also heated, and the ink in the ink nozzles thickens and coagulates, causing ink clogging. Depending on the situation, there is a possibility that the inkjet head will be thermally damaged.

Furthermore, it is difficult to keep the portion of the recording medium passing over the platen in a state of uniform heating. Therefore, nonuniformity occurs in the printing quality, and the printing quality may be compromised.

In addition, nichrome wire or the like has been used as the heating means in the past, but conventional heating means must be constantly energized, and problems with large power consumption and high running costs are encountered.

DISCLOSURE OF THE INVENTION

In view of such circumstances, an object of the present invention is to provide an inkjet printer in which print can be performed with efficient fixing on recording media composed of various materials such as glass plates, metal plates, resin plates, and wooden plates.

To resolve the problems described above, the inkjet printer of the present invention is characterized in having:

an inkjet head;

a platen for regulating the printing position of the inkjet head;

a head carriage for carrying the inkjet head;

a heating device for heating ink droplets discharged from the inkjet head and deposited on a recording medium on the platen, the heating device being mounted in the head carriage; and a cooling mechanism for cooling external peripheral surface portions of the heating device other than a heat release opening; wherein the cooling mechanism comprises a heat pipe disposed in a state of contact with structural components of the heating device on the outside and/or inside of the heating device.

In the inkjet printer of the present invention, a heating device is mounted in the head carriage, and the heating device moves together with the inkjet head. The heating device is positioned in near proximity to the ink droplets discharged from the inkjet head and deposited on the recording medium, and can directly heat and harden the ink droplets. Accordingly, ink droplets can be fixed efficiently to the recording medium.

In cases in which the heating device is disposed in near proximity to the inkjet head, there is the danger that the nozzles of the inkjet head will be clogged by heat released from the heating device, and that the inkjet head itself will be thermally damaged. However, in the present invention, since the heating device is cooled by the cooling mechanism, heating of the inkjet head can be suppressed or prevented. Particularly, in the present invention, since a heat pipe with high thermal conductive efficiency is used as the cooling mechanism, heat released from the heating device can be efficiently emitted to the exterior.

The heating device generally comprises a cylindrical casing in which one open end constitutes the heat release opening. In this case, the heat pipe is disposed in a state of contact with the external peripheral surface and/or internal peripheral surface of the casing. For example, the heat pipe is disposed in a helical formation along the external peripheral surface and/or the internal peripheral surface of the casing.

Next, the present invention is characterized in that the cooling mechanism comprises a heat release member connected to a distal end of the heat pipe. By connecting the end of the heat pipe to a heat sink or another such heat release member having a high thermal capacity, heat is efficiently transmitted via the heat pipe to the heat release member, from which the heat is emitted to the exterior.

In this case, it is preferred that the cooling mechanism comprise an air-blowing device for blowing cooling air onto the heat release member in order to efficiently radiate heat from the heat release member.

An air-blowing device may be used to blow air onto the external peripheral portions of the heating device other than the heat release opening, and these portions may thus be cooled.

Next, the present invention is characterized in that a heat-insulating material is disposed along the internal peripheral surface of the casing, and the heat pipe is disposed between the internal peripheral surface and the heat-insulating material. Thus, release of heat to the periphery can be prevented by providing the heating device with both heat insulation measures and heat release measures. Accordingly, the inkjet head disposed adjacent thereto can be reliably prevented from being heated.

Next, a halogen lamp or another such discharge lamp can be used as the heating device. In this case, the heating device can be configured comprising a halogen lamp or another such discharge lamp, a reflective mirror for reflecting emitted light from the discharge lamp toward the heat release opening, and a cylindrical lens barrel extending coaxially in the emitting direction from the emission opening of the reflective mirror.

In this case, the heat pipe is disposed in a state of contact with the external peripheral surface and/or the internal peripheral surface of the lens barrel. The heat pipe may be disposed in a state of contact with the external peripheral surface of the reflective mirror. In such cases, the heat pipe can be disposed in a helical formation.

Furthermore, a heat release member is preferably connected to the distal end of the heat pipe to improve heat release efficiency. It is also preferred that an air-blowing device for blowing cooling air onto the heat release member be disposed to facilitate heat release efficiency.

A heat-insulating material may be disposed along the internal peripheral surface of the lens barrel, and a heat pipe may be disposed between the internal peripheral surface and the heat-insulating material.

Next, the present invention is characterized in comprising a heat pipe for cooling the inkjet head and/or the head carriage, in addition to the heat pipe for cooling the heating device.

In this case, a heat release member can be connected to the distal end of the heat pipe to improve heat release efficiency. Furthermore, an air-blowing device for blowing cooling air onto the heat release member can be provided, and the efficiency of heat release can be further improved.

An air-blowing device may be included for blowing cooling air onto the inkjet head and/or the head carriage.

Next, the present invention can be used in an inkjet printer comprising an inkjet head for printing by means of resin ink or another such thermosetting ink.

In the inkjet printer of the present invention, a heating device is mounted in the head carriage, ink droplets discharged from the inkjet head and deposited on the recording medium can be directly heated, and a cooling mechanism is disposed so as not to be heated by the heating device disposed adjacent to the inkjet head. In addition, a heat pipe is used which provides good cooling efficiency for the cooling mechanism and which needs only a small space for installation. Therefore, according to the present invention, it is possible to prevent the nozzle clogging brought about by the heating of the inkjet head, and to prevent heat damage and other such harmful effects to the inkjet head itself, and the ink droplets can be efficiently hardened by heat and fixed on the recording medium.

BEST MODE FOR CARRYING OUT THE INVENTION

An inkjet printer to which the present invention is applied is described hereinbelow with reference to the drawings.

Figure 1:
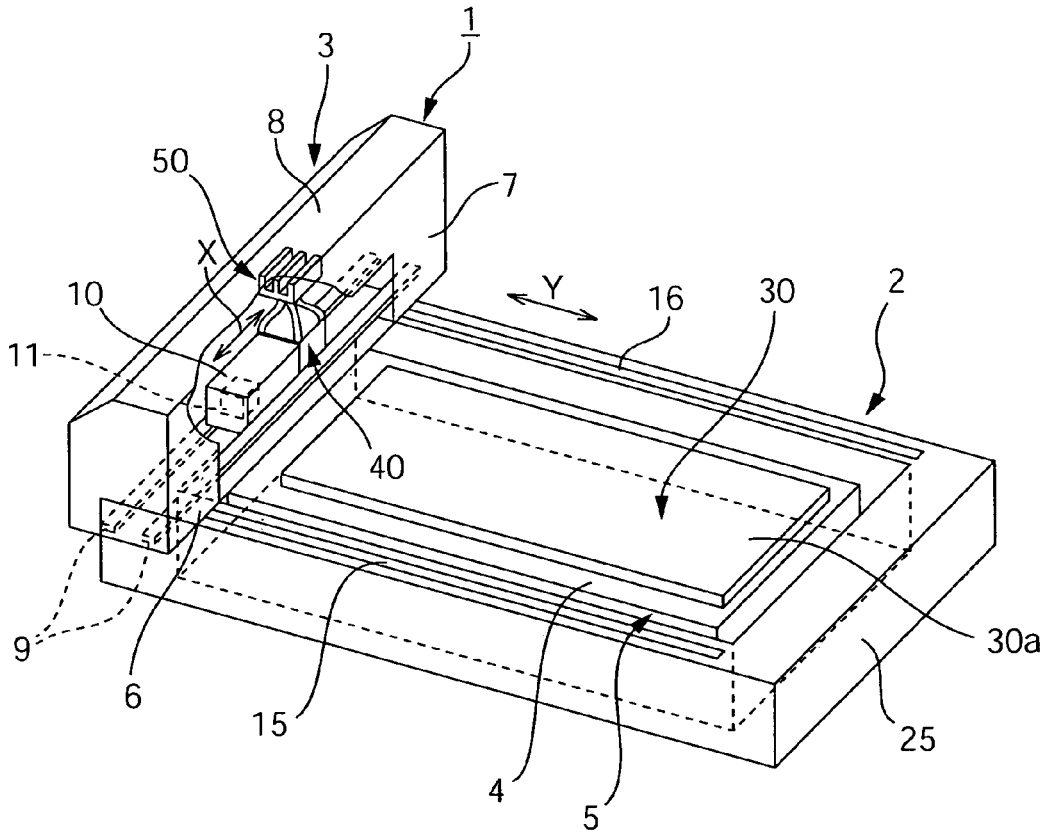
FIG. 1 is a schematic perspective view of an inkjet printer to which the present invention is applied.
Figure 2:
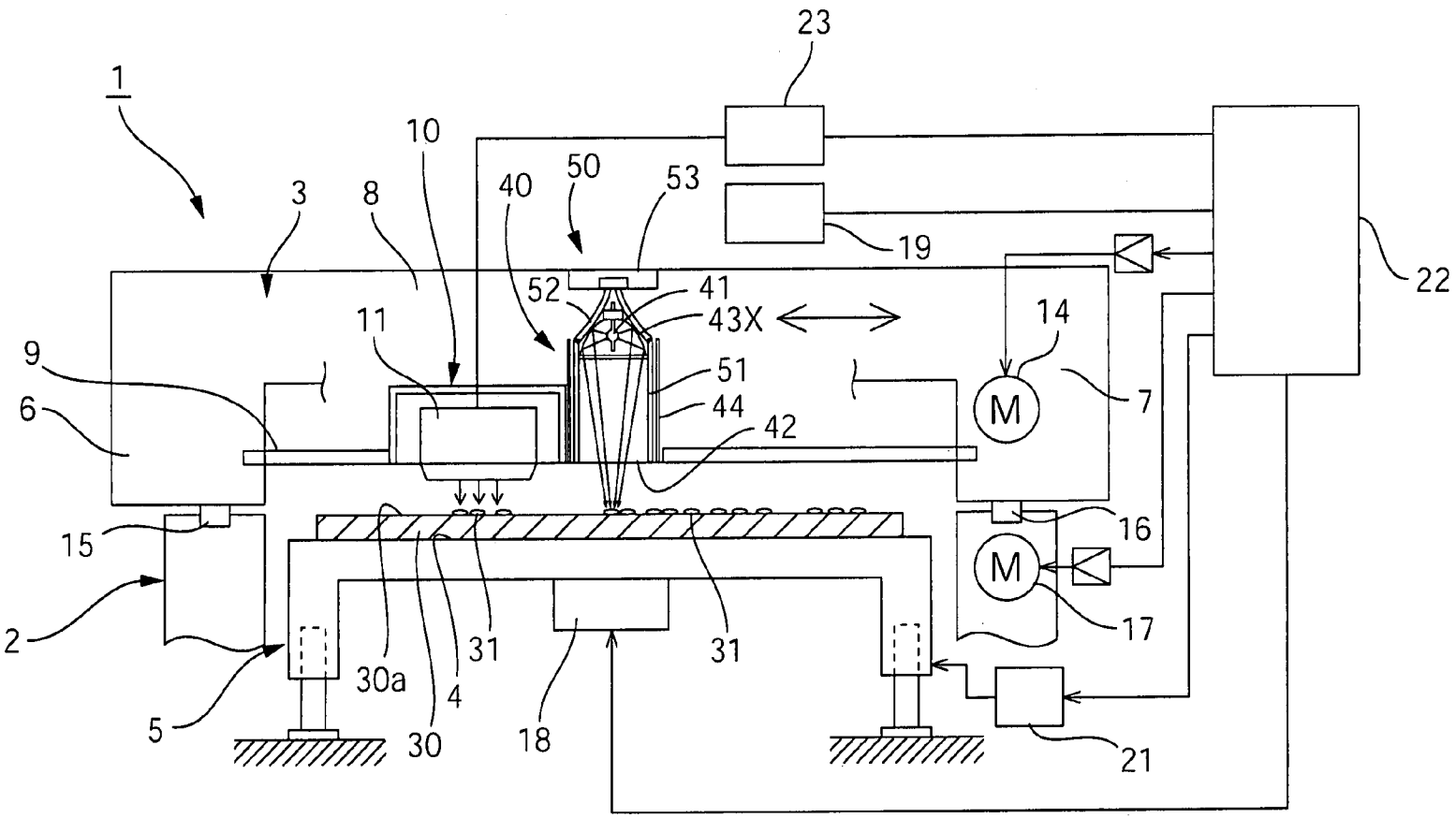
FIG. 2 is a schematic structural view of the inkjet printer in FIG. 1.

FIG. 1 is a schematic perspective view showing the inkjet printer of the present example, and FIG. 2 is a schematic structural view including the control system thereof. The inkjet printer 1 of the present example has an oblong rectangular frame-shaped cradle 2, a gate-shaped support unit 3 mounted on the cradle 2, and a table 5 (platen) provided with a horizontal rectangular medium-carrying surface 4 placed inside the cradle 2.

The support unit 3 includes left and right vertical frames 6, 7, and a horizontal frame 8 spanning the space between the vertical frames. The horizontal frame 8 includes a carriage guide 9 horizontally spanning the space between the left and right vertical frames 6, 7; and a head carriage 10 is capable of moving back and forth in the printer width direction along the carriage guide 9. An inkjet head 11 is supported facing downward in the head carriage 10. The head carriage 10 is moved back and forth in the printer width direction X by a carriage drive mechanism that includes a carriage motor 14.

A heating lamp unit 40 (heating device) provided with a halogen lamp 41 is attached to the head carriage 10 on one side in the moving direction. Irradiated light from the heating lamp unit 40 is directed downward from a heat release opening 42. A heating lamp other than a halogen lamp can be used. Heating means other than a heating lamp can also be used. Furthermore, heating lamp units may be attached to both sides of the head carriage 10.

Resin ink is supplied to the inkjet head 11 from an ink tank (not shown), and the resin ink is used to perform printing on a print surface 30*a* of a recording medium 30 placed on the medium-carrying surface 4. Thermosetting ink other than resin ink can also be used.

Next, the support unit 3 on which the head carriage 10 and other components are mounted is supported in a manner that allows the support unit to move in the printer length direction Y along left and right guide frames 15, 16 of the cradle 2. The support unit 3 is moved in the printer length direction Y by a conveying mechanism that includes a conveying motor 17.

Next, the table 5 is provided with a heating mechanism 18 for heating the medium-carrying surface 4. The recording medium 30 placed on the medium-carrying surface 4 is heated from the reverse side by the heating mechanism 18. The portions on which ink droplets are deposited from above are also heated in spots by the heating lamp unit 40, which moves together with the head carriage 10. In the present example, a temperature control function is incorporated in the heating mechanism 18, and a drive electric current is supplied to the heating lamp unit 40 via a voltage control circuit 19 composed of a power transformer or the like, making it possible to control the heating temperature.

The table 5 is, e.g., a hydraulic rising and lowering table, and the table height can be adjusted by a hydraulic drive mechanism 21. The parts are controlled by a printer control board 22 based on a microcomputer or the like.

Figure 3:
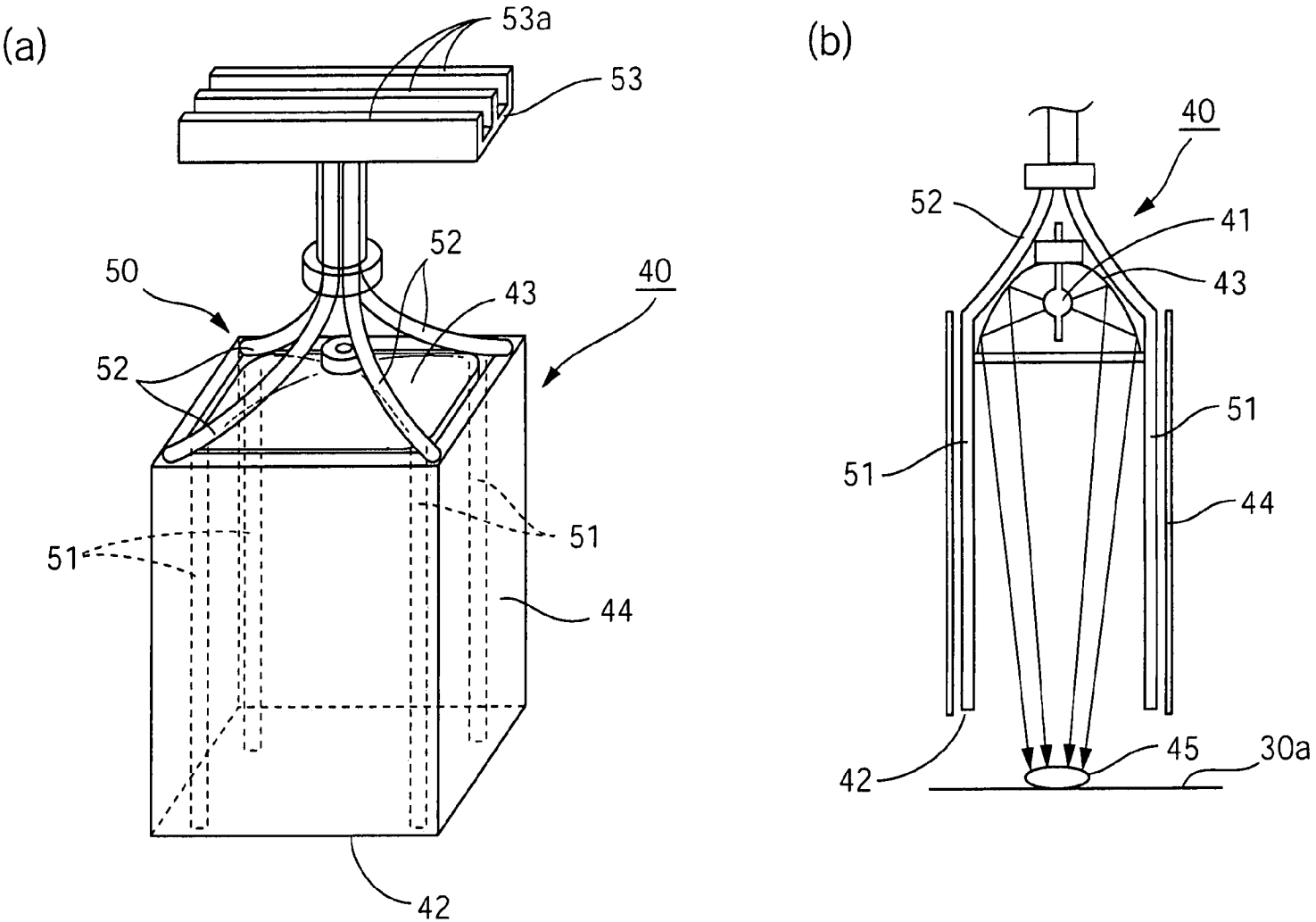
FIG. 3 is a schematic perspective view and a schematic cross-sectional view showing the heating device and cooling mechanism in FIG. 1.

FIG. 3 is a schematic perspective view and a schematic cross-sectional view showing the heating lamp unit 40 mounted on the head carriage 10. The heating lamp unit 40 includes a halogen lamp 41, a reflective mirror 43 to which the halogen lamp 41 is attached, and a lens barrel 44 that is rectangular in cross section and is attached in a coaxial state on the emission opening side of the reflective mirror 43. The opening at the lower end of the lens barrel 44 constitutes the heat release opening 42. The lens barrel 44 may have a shape other than a rectangle in cross section; for example, the lens barrel may be a cylinder. Light emitted by the light-emitting part of the halogen lamp 41 is reflected by the reflective mirror 43, a light spot 45 having a specific diameter is formed on the print surface 30*a* of the recording medium 30 on the medium-carrying surface 4, and this area of the print surface 30*a* is heated.

A cooling mechanism 50 composed of heat pipes is attached to the heating lamp unit 40 having this structure. The cooling mechanism 50 of the present example includes four internal heat pipes 51 extending vertically at the four corners of the internal peripheral surface of the lens barrel 44. The top ends of these internal heat pipes 51 protrude upward from the top end surface of the lens barrel 44. The top ends are respectively connected to four external heat pipes 52 disposed along the back surface of the reflective mirror 43. The number of heat pipes is not limited to four, and may also be one or a plural number other than four. The heat pipes may have a linear shape, a curved shape, or a helical shape.

These external heat pipes 52 converge together and extend upward, and the top ends thereof are attached to the bottom surface of a horizontally extending heat release plate 53. The heat release plate 53 is supported to be capable of moving in the printer width direction along a guide (not shown) formed on the inside of the support unit 3. A plurality of heat release fins 53*a* extending in the movement direction is formed in the surface of the heat release plate 53. The heat release plate can be omitted in cases in which the amount of heat given off by the heating lamp unit 40 is not large; i.e., in cases in which the heating lamp unit 40 can be sufficiently cooled and heating-induced harmful effects can be prevented from occurring in the inkjet head 11 merely by the heat release action of the heat pipes 51, 52.

The operation of the inkjet printer 1 having this configuration will be described. The recording medium 30 is placed on the medium-carrying surface 4 of the table 5, and the gap between the inkjet head 11 and the print surface 30*a* of the recording medium 30 is adjusted by the hydraulic drive mechanism 21. The heating mechanism 18 is driven and caused to heat the medium-carrying surface 4 either before or after the gap is adjusted.

The carriage motor 14 and the conveying motor 17 are then driven to move the support unit 3 in the printer length direction Y from a home position (not shown), and to move the head carriage 10 mounted thereon in the printer width direction X. The inkjet head 11 is synchronously driven via a head driver 23, and the desired printing is performed while resin ink droplets are discharged onto the print surface 30*a* of the recording medium 30.

The heating lamp unit 40 is switched on prior to the printing operation of the inkjet head 11. Accordingly, heat rays are instantly directed onto the resin ink droplets 31 discharged from the inkjet head 11 and deposited onto the print surface 30*a* of the recording medium 30, and thermosetting is initiated. In the present example, since the medium-carrying surface 4 is also heated, the print surface 30*a* of the recording medium 30 is held in an optimal heated state suitable for the thermosetting of the resin ink. Accordingly, the resin ink droplets are fixed on the print surface 30*a* at the same time as the printing operation. Thus, printing is performed on the print surface 30*a* of the recording medium 30 while printing and thermosetting are performed simultaneously.

The heating lamp unit 40 is cooled by the cooling mechanism 50 disposed thereon. Specifically, the heat generated by the heating lamp unit 40 is emitted to the heat release plate 53 via the four internal heat pipes 51 and external heat pipes 52. Since the heat release plate 53 moves in the printer width direction X together with the head carriage 10, the heat accumulated thereon is efficiently emitted to the exterior from the heat release fins 53*a* of the heat release plate 53. When the printing operation ends, the support unit 3 returns back to the home position (not shown).

As described above, in the inkjet printer 1 of the present example, printing is performed using resin ink on the print surface of the recording medium 30. Accordingly, printing can be performed without performing a surface preparation process in advance in order to form an ink-receiving surface on recording media of various materials.

Since the thermosetting of the resin ink is performed by the heating lamp unit 40 at the same time as the printing operation, a printed recording medium is obtained in a state in which the ink is fixed at the same time that the printing operation ends. In addition, since the medium-carrying surface 4 is also heated by the heating mechanism 18, the resin ink can be efficiently hardened by heat, and an efficient printing operation using resin ink can therefore be achieved.

Furthermore, the cooling mechanism 50 is attached to the heating lamp unit 40, and the heat generated by the heating lamp unit 40 is efficiently emitted to the exterior from the heat release plate 53. Accordingly, the inkjet head 11 disposed at an adjacent position is heated by the heat from the heating lamp unit 40, and nozzle clogging, heat damage to the inkjet head itself, and other such problems can be prevented.

In addition, in the present example, since the platen gap can be adjusted by raising and lowering the table 5, printing can be performed without reducing print quality on recording media of various thicknesses, ranging from thin cloths, films, and the like, to thick resin plates, metal plates, wooden plates, and the like.

Next, the cradle 2 of the present example has a rectangular frame shape, but another option is for a front frame 25 spanning the space between the left and right guide frames 15, 16 to have a dismounted structure. In this case, by attaching wheels or the like to the table 5 disposed between the left and right guide frames 15, 16, it is possible to pull out the table from the mounting position between the left and right guide frames 15, 16. An arrangement can in which the recording medium is set can be formed by pulling out the table 5, placing the recording medium in another location, and positioning the table for carrying the recording medium between the left and right guide frames 15, 16. The recording medium can thereby be replaced easily and efficiently. This is particularly effective in cases in which printing is performed on a heavy, large-sized recording medium.

The example described above is one in which the present invention is applied to a large-sized inkjet printer. It is apparent that the present invention can be similarly applied to a small-sized printer for printing on paper, film, cloth, or the like.

Other Embodiments

Figure 4:
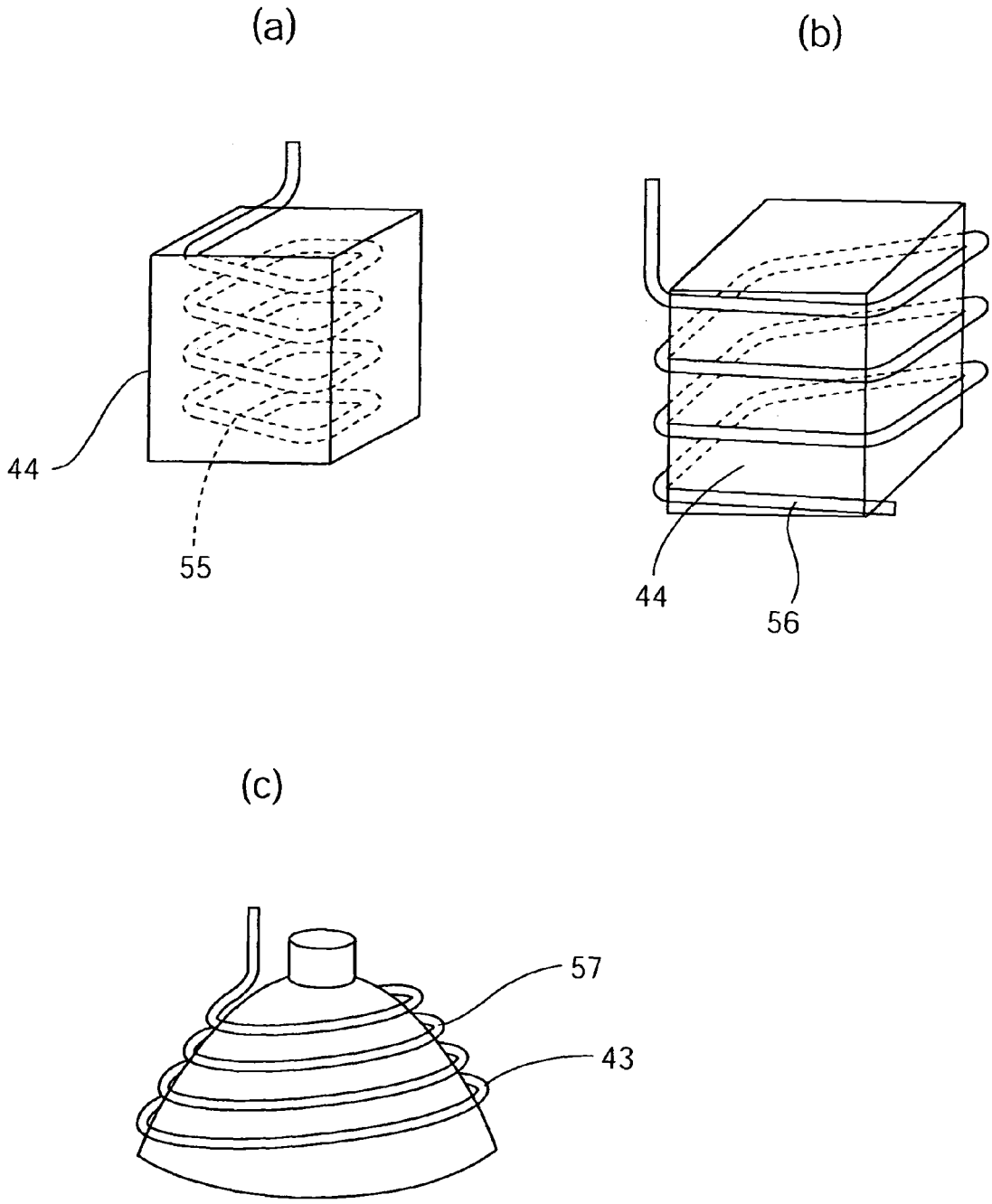
FIG. 4 is an explanatory diagram showing an example of arranging the heat pipe.

FIG. 4 is an explanatory diagram showing an example of the heat pipe arrangement in the cooling mechanism 50. In the example in FIG. 4(*a*), one heat pipe 55 is attached in a helical formation along the internal peripheral surface of the lens barrel 44 of the heating lamp unit 40. In the example in FIG. 4(*b*), one heat pipe 56 is attached in a state of encircling the external peripheral surface of the lens barrel 44 in a helical formation. In the example in FIG. 4(*c*), one heat pipe 57 is attached in the shape of a circular truncated cone along the back surface of the reflective mirror 43 (lamp cover) of the heating lamp unit 40.

Figure 5:
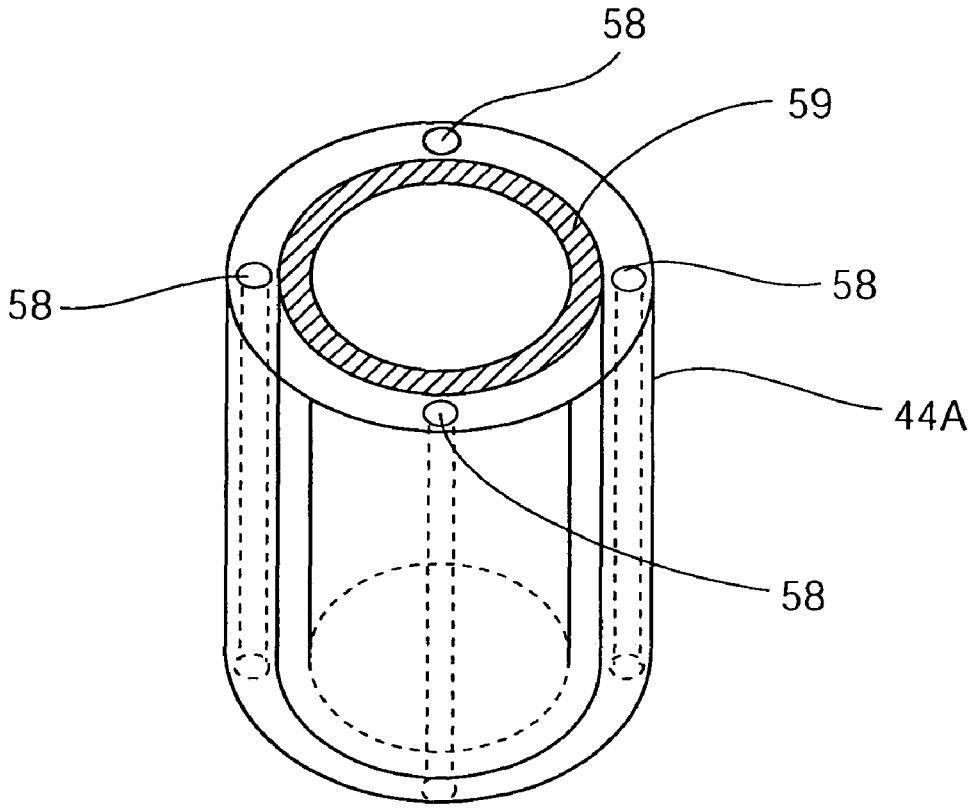
FIG. 5 is an explanatory diagram showing a heating device provided with a heat-insulating material.
Figure 8:
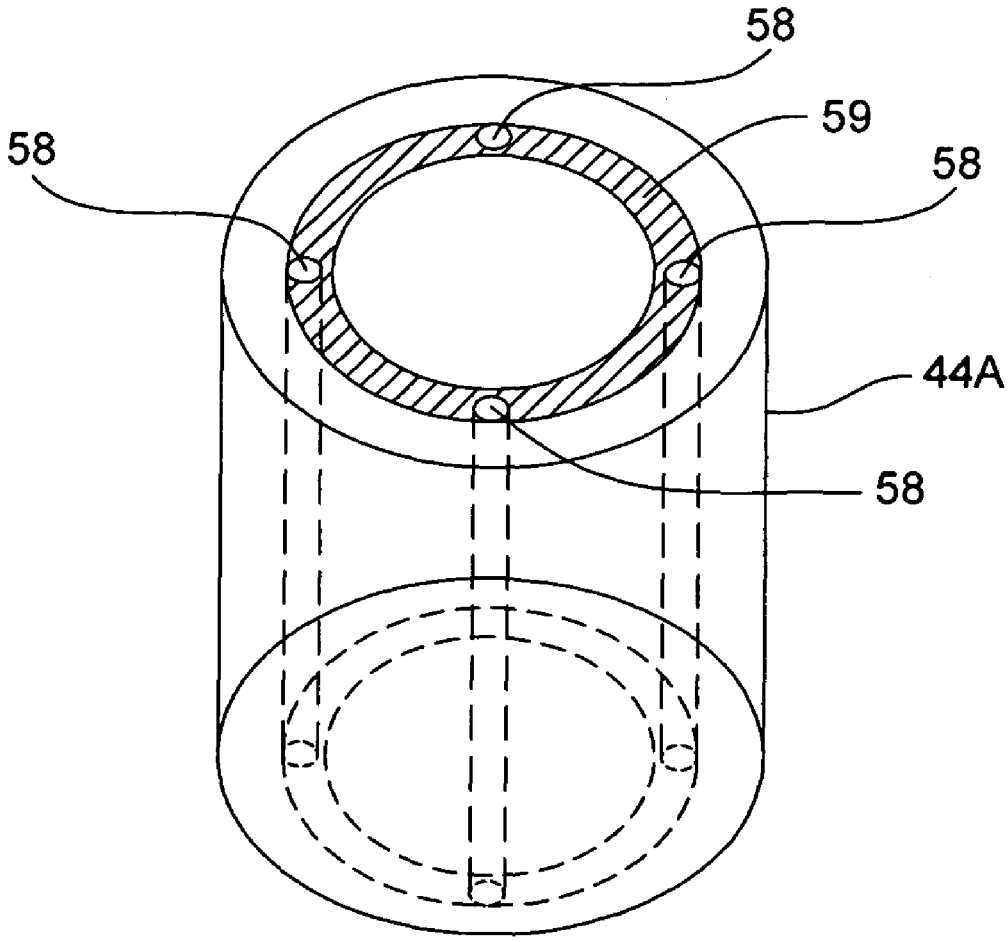
FIG. 8 is an explanatory diagram showing another embodiment of a heating device provided with a heat-insulating material.

Another possibility is to combine the cooling mechanism 50 with a heat-insulating material so that the inkjet head 11 is not heated. For example, a cylindrical shape may be used for a lens barrel 44A of the heating lamp unit 40, and four heat pipes 58, for example, may be disposed in the axial direction of the lens barrel at equal intervals, as shown in FIG. 5. A cylindrical heat-insulating material 59 may be disposed on the inside of the lens barrel so as to cover the heat pipes 58 and the internal peripheral surface of the lens barrel as shown in FIG. 8. The inkjet head 11 can thus be prevented from being heated using the effects of heat release and heat insulation.

Figure 6:
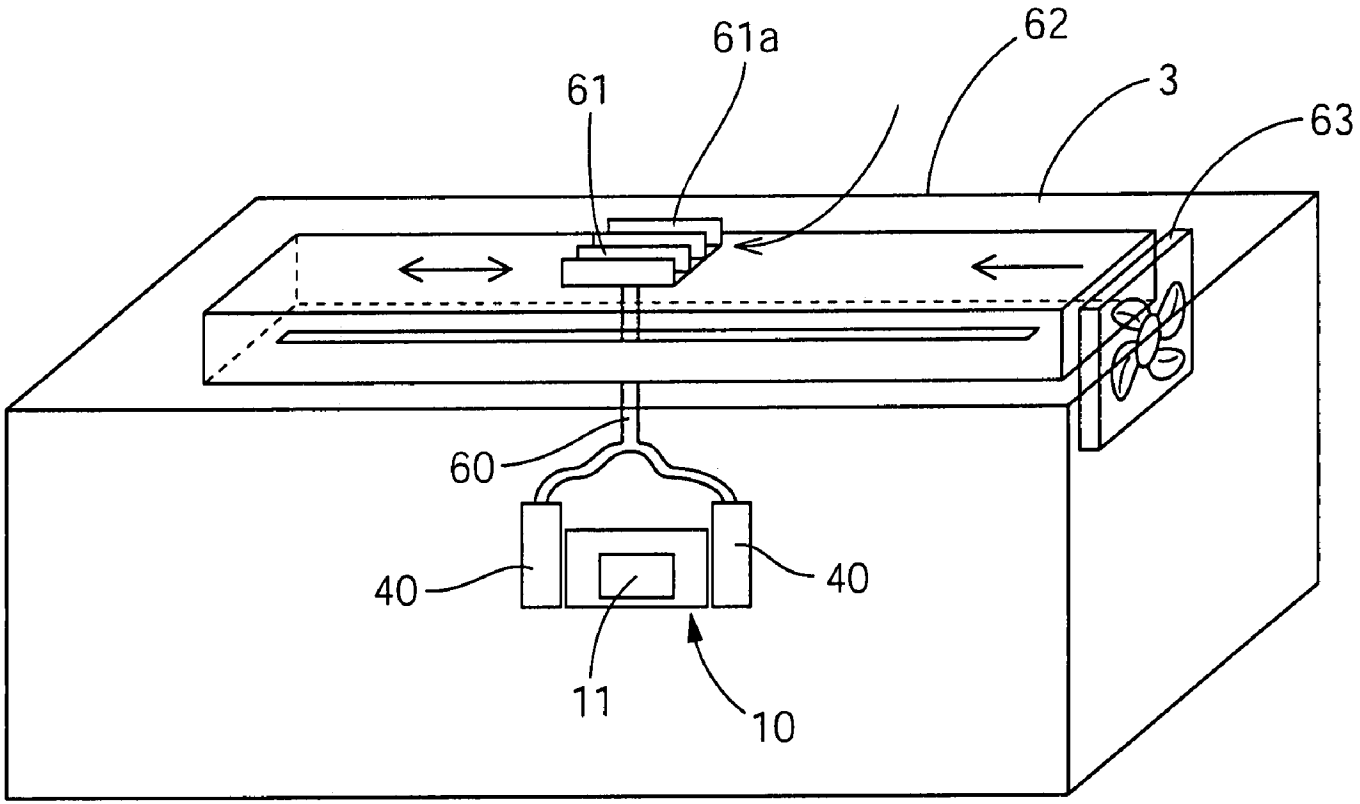
FIG. 6 is an explanatory diagram showing an example of a cooling mechanism provided with a heat pipe and an air-blowing device.

An air cooling mechanism can be used together with the heat pipes as the cooling mechanism 50. For example, in cases in which heating lamp units 40 are attached to both sides of the head carriage 10 as shown in FIG. 6, a plurality of heat pipes 60 disposed thereon converge together and extend upward, and the top ends of the pipes are connected to a heat release plate 61. The heat release plate 61 includes a large number of heat release fins 61*a* on the surface. The heat release plate 61 is supported in a state of being able to move in the printer width direction through a duct 62 that extends in the printer width direction and is formed inside the support unit 3 in FIG. 1. An air-blowing device 63 for air cooling is attached at one end of the duct 62, and air for cooling can be blown in the printer width direction onto the heat release plate 61.

According to this configuration, cooling effects are increased because the heat release plate 61 is air-cooled. Since air from the exterior is brought in by the air-blowing device 63, this also provides the merit of increased cooling effects.

Figure 7:
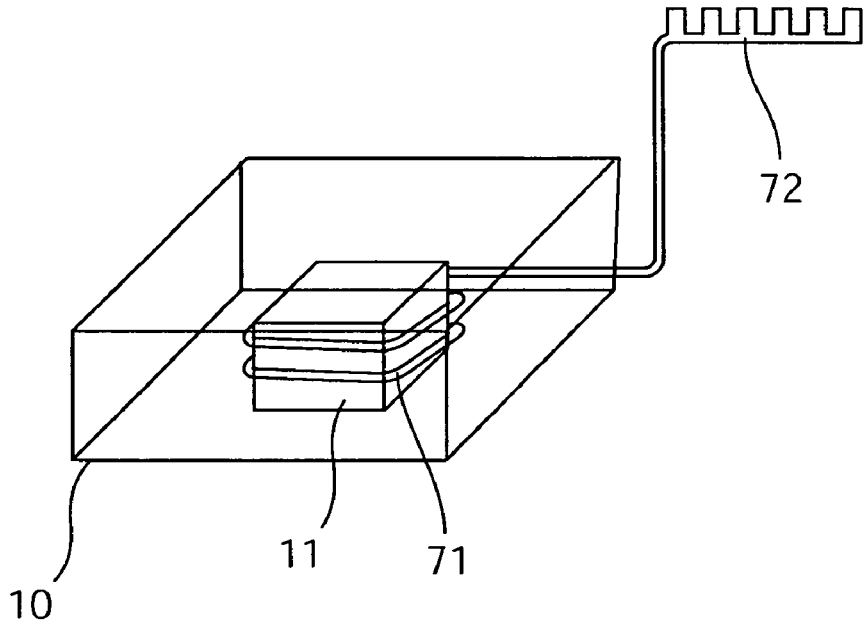
FIG. 7 is an explanatory diagram showing an example of the cooling mechanism of the inkjet head.

Yet another possibility is to attach the cooling mechanism 50 to the heating lamp unit 40 and to attach the cooling mechanism to the inkjet head 11 or the head carriage 10 as well, in which case these components can be cooled directly. For example, as shown in FIG. 7, a heat pipe 71 is disposed in a state of encircling the external periphery of the inkjet head 11 mounted in the head carriage 10, and the distal end of the pipe leads out of the head carriage 10 and connects to a heat release plate 72, which moves integrally with the head carriage 10 in the printer width direction. According to this configuration, the inkjet head 11 can be reliably prevented from being trapped in a heated state.

Instead of this option or in addition to this option, the head carriage 10 and/or the inkjet head 11 may be cooled.

(Method of Controlling Heating Device)

In cases in which the recording media to be printed are made of different materials, the recording media have different specific heats, and the irradiation temperature suitable for hardening the ink droplets deposited thereon must be varied. The drive voltage and drive electric current of the heating means, i.e., the heating lamp, can be controlled as a way of varying the irradiation temperature. A light-blocking filter can also be placed in the irradiation path of the irradiation light to increase or decrease the amount of irradiation light and to vary the irradiation temperature.

To control of the irradiation temperature by switching, it is possible, for example, to provide a manual selection switch and to perform stepwise switching by operating this switch. A program for controlling the irradiation temperature may be installed in the printer drivers, and the irradiation temperature may be automatically controlled according to the surrounding temperature, the type of material of the selected recording medium, and other such factors.

It is also preferable to control the heating device so that the device heats only when necessary. Specifically, if the heating device is switched on to heat the surface of the recording medium only when printing is actually performed by the inkjet head 11, heating of the inkjet head 11 can be suppressed, and the power consumed by the heating device can be reduced.

In cases in which a halogen lamp or another such discharge lamp is used as the lamp of the heating lamp unit, the halogen lamp is preferably drivably controlled in the following manner. First, when the switch of the halogen lamp is closed, the lamp ignites instantly and heats to a target temperature. To increase the speed at which the temperature rises, a semi-ignited state can be achieved by controlling the drive voltage of the halogen lamp.

The lamp is switched to a fully ignited state only when the inkjet head is printing; otherwise the lamp is turned off or kept in the semi-ignited state. For example, this state is maintained when the inkjet head is in standby in the home position or when the inkjet head is being cleaned. Furthermore, a thermistor or a thermocouple is used for the lamp drive control circuit, and the temperature is controlled so as not to increase in an extreme manner. An emergency shutdown circuit is also provided to forcibly switch the lamp off in an emergency.

An irradiation temperature control circuit is preferably provided because the irradiation temperature must be varied depending on the recording medium.

The invention claimed is:

1. An inkjet printer, comprising:

an inkjet head;

a platen for regulating a printing position of the inkjet head;

a head carriage for carrying the inkjet head;

a heating device mounted on the head carriage for heating ink droplets discharged from the inkjet head and deposited on a recording medium on the platen; and a cooling mechanism for cooling external peripheral surface portions of the heating device, other than a heat release opening thereof; wherein the cooling mechanism comprises a heat pipe disposed in a state of contact with structural components of the heating device on an inside of the heating device;

the heating device comprises a cylindrical casing in which one open end constitutes the heat release opening;

a heat-insulating material is disposed along the internal peripheral surface of the casing; and the heat pipe is disposed between the inner peripheral surface and the heat-insulating material.

2. The inkjet printer according to claim 1, characterized in that the cooling mechanism comprises a heat release member connected to a distal end of the heat pipe.

3. The inkjet printer according to claim 2, characterized in that the cooling mechanism comprises an air-blowing device for blowing cooling air onto the heat release member.

4. The inkjet printer according to claim 1, characterized in that the cooling mechanism comprises an air-blowing device for blowing cooling air onto external peripheral surface portions of the heating device other than the heat release opening.

5. The inkjet printer according to claim 1, characterized in that the heating device comprises a halogen lamp or another such discharge lamp, a reflective mirror for reflecting emitted light from the discharge lamp toward the heat release opening, and a cylindrical lens barrel extending coaxially in an emitting direction from an emission opening of the reflective mirror.

6. The inkjet printer according to claim 1, characterized in that the heat pipe is disposed in a helical formation.

* * * * *